US009523253B2

(12) United States Patent
Hallundbæk

(10) Patent No.: US 9,523,253 B2
(45) Date of Patent: Dec. 20, 2016

(54) TORQUE MEMBER

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 654 days.

(21) Appl. No.: 14/007,655

(22) PCT Filed: Mar. 29, 2012

(86) PCT No.: PCT/EP2012/055642
§ 371 (c)(1),
(2), (4) Date: Sep. 26, 2013

(87) PCT Pub. No.: WO2012/130943
PCT Pub. Date: Oct. 4, 2012

(65) Prior Publication Data

US 2014/0014323 A1 Jan. 16, 2014

(30) Foreign Application Priority Data

Mar. 30, 2011 (EP) ..... 11160498

(51) Int. Cl.
*E21B 23/04* (2006.01)
*E21B 23/14* (2006.01)
*E21B 23/00* (2006.01)

(52) U.S. Cl.
CPC ..... *E21B 23/04* (2013.01); *E21B 23/14* (2013.01); *E21B 2023/008* (2013.01)

(58) Field of Classification Search
CPC ..... E21B 23/04; E21B 23/14; E21B 2023/008
See application file for complete search history.

(56) References Cited

U.S. PATENT DOCUMENTS 3,831,443 A * 8/1974 Planche ..... E21B 17/1021 137/614.05
6,273,189 B1 8/2001 Gissler et al.
(Continued)

FOREIGN PATENT DOCUMENTS

GB 2 415 718 B 3/2007
NO WO 2008091157 A1 * 7/2008 ..... E21B 4/18
(Continued)

OTHER PUBLICATIONS

International Preliminary Report on Patentability issued in International Patent Application No. PCT/EP2012/055642 issued on Oct. 1, 2013.
(Continued)

*Primary Examiner* — Robert E Fuller
*Assistant Examiner* — David Carroll
(74) *Attorney, Agent, or Firm* — Nixon & Vanderhye P.C.

(57) ABSTRACT

A downhole tool extending in a longitudinal direction includes a tool housing; an arm assembly movable between a retracted position and a projecting position in relation to the tool housing; and an arm activation assembly arranged in the tool housing for moving the arm assembly between the retracted position and the projecting position. The arm activation assembly has a piston chamber extending in the longitudinal direction of the downhole tool, and a piston member arranged inside the piston chamber and movable in the longitudinal direction of the downhole tool. The arm activation assembly further includes a torque member with a first fluid channel for supplying hydraulic fluid from a pump to the arm assembly, the torque member being connected with the arm assembly. The torque member is rotated by the movement of the piston member, whereby the arm assembly is moved.

14 Claims, 11 Drawing Sheets

(56) References Cited

U.S. PATENT DOCUMENTS

| | | | | |
|---|---|---|---|---|
| 2009/0071659 | A1 | 3/2009 | Spencer et al. | |
| 2009/0223659 | A1 | 9/2009 | Hill et al. | |
| 2010/0012315 | A1 | 1/2010 | McInally | |
| 2012/0037358 | A1 | 2/2012 | Ferkingstad et al. | |
| 2014/0014315 | A1* | 1/2014 | Hallundbæk ..... | E21B 23/14 166/55 |

FOREIGN PATENT DOCUMENTS

| | | | |
|---|---|---|---|
| RU | 2 363 846 | C2 | 8/2009 |
| RU | 2 389 867 | C1 | 5/2010 |
| WO | WO 93/18277 | | 9/1993 |
| WO | WO 2006/115418 | | 11/2006 |
| WO | WO 2008/091157 | | 7/2008 |
| WO | WO 2008/111844 | | 9/2008 |
| WO | WO 2009/020397 | | 2/2009 |
| WO | WO 2009/111693 | | 9/2009 |
| WO | WO 2010/123375 | | 10/2010 |

OTHER PUBLICATIONS

International Search Report for PCT/EP2012/055642, mailed Apr. 27, 2012.
Written Opinion for PCT/EP2012/055642, mailed Apr. 27, 2012.

* cited by examiner

TORQUE MEMBER

This application is the U.S. national phase of International Application No. PCT/EP2012/055642 filed 29 Mar. 2012 which designated the U.S. and claims priority to EP Patent Application No. 11160498.9 filed 30 Mar. 2011, the entire contents of each of which are hereby incorporated by reference.

FIELD OF THE INVENTION

The present invention relates to a downhole tool, comprising a tool housing; an arm assembly movable between a retracted position and a projecting position in relation to the tool housing; an arm activation assembly arranged in the tool housing for moving the arm assembly between the retracted position and the projecting position. Furthermore, the invention relates to a downhole system comprising the downhole tool according to the invention and an operational tool.

BACKGROUND ART

Downhole tools are used for operations inside boreholes of oil and gas wells. Downhole tools operate in a very harsh environment and must be able to withstand inter alia corrosive fluids, very high temperatures and pressure.

To avoid unnecessary and expensive disturbances in the production of oil and gas, the tools deployed downhole have to be reliable and easy to remove from the well in case of a breakdown. Tools are often deployed at great depths several kilometers down the well, and removing jammed tools are therefore a costly and time-consuming operation.

Well tools are often part of a larger tool string containing tools with different functionalities. A tool string may comprise both transportation tools for propelling the tool string in the well and operational tools for performing various operations downhole.

Well tools often utilise hydraulics for performing operations or providing propulsion in transportation tools, also denoted well tractors. Supplying pressurised hydraulic fluid to various parts of a downhole tool requires a reliable and robust hydraulic system, as tools in the well cannot be accessed easily.

Especially the supply of hydraulic fluid into moving parts of a downhole tool is challenging. In regular machines, this is often accomplished by utilising external, flexible hydraulic hoses, which provide great freedom of design. In downhole tools the use of external hoses is undesirable due to the risk of hoses getting torn or the tool getting stuck due to entangled hoses.

SUMMARY OF THE INVENTION

It is an object of the present invention to wholly or partly overcome the above disadvantages and drawbacks of the prior art. More specifically, it is an object to provide an improved downhole tool wherein hydraulic fluid can be supplied to hydraulic entities, e.g. a hydraulic piston or motor, arranged in connection with moving parts of the downhole tool, such as a pivotally mounted arm.

The above objects, together with numerous other objects, advantages, and features, which will become evident from the below description, are accomplished by a solution in accordance with the present invention by a downhole tool extending in a longitudinal direction, comprising a tool housing; an arm assembly movable between a retracted position and a projecting position in relation to the tool housing; and an arm activation assembly arranged in the tool housing for moving the arm assembly between the retracted position and the projecting position, the arm activation assembly comprising: a piston chamber extending in the longitudinal direction of the downhole tool, and a piston member arranged inside the piston chamber and movable in the longitudinal direction of the downhole tool, wherein the arm activation assembly further comprises a torque member connected with the arm assembly and wherein the torque member is rotated by the movement of the piston member, whereby the arm assembly is moved.

In one embodiment, the torque member may comprise a first fluid channel for supplying hydraulic fluid from a pump to the arm assembly.

Hereby, fluid can be supplied through the torque member an into the arm assembly using internal fluid channels, as an alternative to external fluid channels such as hydraulic hoses. The torque member thus has the dual functionality of simultaneously transferring torque between the arm activation assembly and the arm assembly and supplying hydraulic fluid to the arm assembly. The use of internal fluid channels provides a more robust hydraulic circuit and reduces the risk of the sealing properties of the hydraulic circuit being compromised.

The first fluid channel may extend through the torque member.

Also, the first fluid channel may be provided as a recess in an external surface of the torque member.

In another embodiment, the torque member may be a cylindrical member having an external surface extending in a periphery of the cylindrical member, the torque member further having a first and a second end face, and the first fluid channel may extend between an inlet provided in the first end face of the torque member and an outlet provided in the external surface.

Furthermore, the torque member may comprise a second fluid channel extending between a second inlet and a second outlet.

The inlet of the second fluid channel may be provided in the external surface of the torque member, and the outlet of the second fluid channel may be provided in the second end face.

Moreover, the arm assembly may comprise an arm member connected with the torque member, a hydraulic motor, and a rotational part, the hydraulic motor being arranged at an end of the arm member and rotationally connected with the rotational part to rotate the rotational part and thereby drive the downhole tool forward.

In one embodiment, the rotational part may comprise a wheel ring constituting a wheel for the downhole tool.

In addition, the hydraulic motor may rotate around an axis of rotation, and the wheel ring of the rotational part may rotate around an axis of rotation coinciding with the axis of rotation of the hydraulic motor.

Also, the arm member may comprise a fluid influx channel fluidly connected with the first fluid channel of the torque member, whereby hydraulic fluid may be supplied from the first fluid channel in the torque member and into the first fluid channel in the arm member.

Furthermore, the arm member may comprise a through hole extending from one side of the arm member to another and defining a circumferential wall, and a part of the torque member may constitute an arm member interface extending in a longitudinal direction of the torque member, wherein an outlet of the first fluid channel of the torque member is arranged in the arm member interface and an inlet of the fluid influx channel is arranged in the circumferential wall defined by the through hole, the arm member interface being adapted to engage with the through hole, so that the outlet and the inlet are fluidly connected.

The arm member may further comprise a fluid reflux channel fluidly connected with the second fluid channel of the torque member.

In one embodiment, the outlet of the fluid reflux channel of the arm member may be arranged in the circumferential wall defined by the through hole, and the inlet of the second fluid channel of the torque member may be arranged in the torque member interface, so that the outlet and the inlet are fluidly connected.

Additionally, the fluid influx channel and the fluid reflux channel may be fluidly connected to the hydraulic motor for supplying hydraulic fluid to and from the motor.

Further, the through hole may have a cross-sectional shape, in a direction transverse to the extension of the through hole, corresponding to a cross-sectional shape of the arm member interface, in a direction transverse to the longitudinal direction of the torque member, the cross-sectional shape of both the though hole and the arm member interface being two-sided, trilateral, triangular, rectangular, multilateral, or oval.

Each of the through hole and the arm member interface may have multiple grooves and protrusions extending in the longitudinal direction, the grooves of the through hole being adapted to receive protrusions of the arm member interface.

Also, the through hole may have a geometry comprising multiple faces and the arm member interface may have a geometry comprising multiple faces, and the outlet of the through hole and the inlet of the arm member interface may be arranged on opposite faces and the inlet of the through hole and the outlet of the arm member interface may be arranged on other opposite faces.

Hereby, different pairs of outlets and inlets are separated from each other to avoid leakage between different pairs of outlets and inlets. Further, the multifaced geometry provides a geometry whereby torque may be transferred from the torque member to the arm member.

The arm assembly may further comprise a tube member arranged in a bore in the arm member for fluidly connecting the first fluid channel of the torque member with the fluid influx channel of the arm member, whereby the tube member provides a fluid communication between the first fluid channel and the fluid influx channel.

Said tube member may extend through the bore and into engagement with the outlet or the inlet arranged in the arm member interface, whereby the torque member is secured in the through hole of the arm member.

Moreover, the tube member may be a bolt comprising an inner bore extending between an inlet and an outlet to provide a fluid channel.

The bolt may be threaded into the bore of the arm member whereby one end of the bolt engages with the outlet of the first fluid channel of the torque member to provide a fluid-tight connection.

In one embodiment, the tool housing may comprise a fluid supply channel, and the first fluid channel of the torque member may be fluidly connected with the fluid supply channel of the tool housing by the first end face of the torque member extending into the tool housing.

In another embodiment, the tool housing may comprise a first tool housing part and a second tool housing part, wherein a fluid return channel may be provided in the second tool housing part and the fluid supply channel may be provided in the first tool housing part, and wherein the second fluid channel of the torque member may be fluidly connected with the fluid supply channel by the second end face of the torque member extending into the second tool housing part.

The downhole tool according to the invention may further comprise a hydraulic pump, the hydraulic pump being in fluid communication with the hydraulic motor via the fluid supply channel, the first fluid channel of the torque member and the fluid influx channel, whereby the hydraulic pump propels the hydraulic motor.

Also, the torque member may constitute a crank shaft and the crank shaft may be connected with a crank arm extending radially from the crank shaft.

The crank arm may be connected with the piston member by the crank arm being arranged in a recess in the piston member.

The present invention further relates to a downhole system comprising the downhole tool according to the invention and an operational tool connected with the downhole tool for being moved forward in a well or borehole. The operational tool may be a stroker tool, a key tool, a milling tool, a drilling tool, a logging tool, etc.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
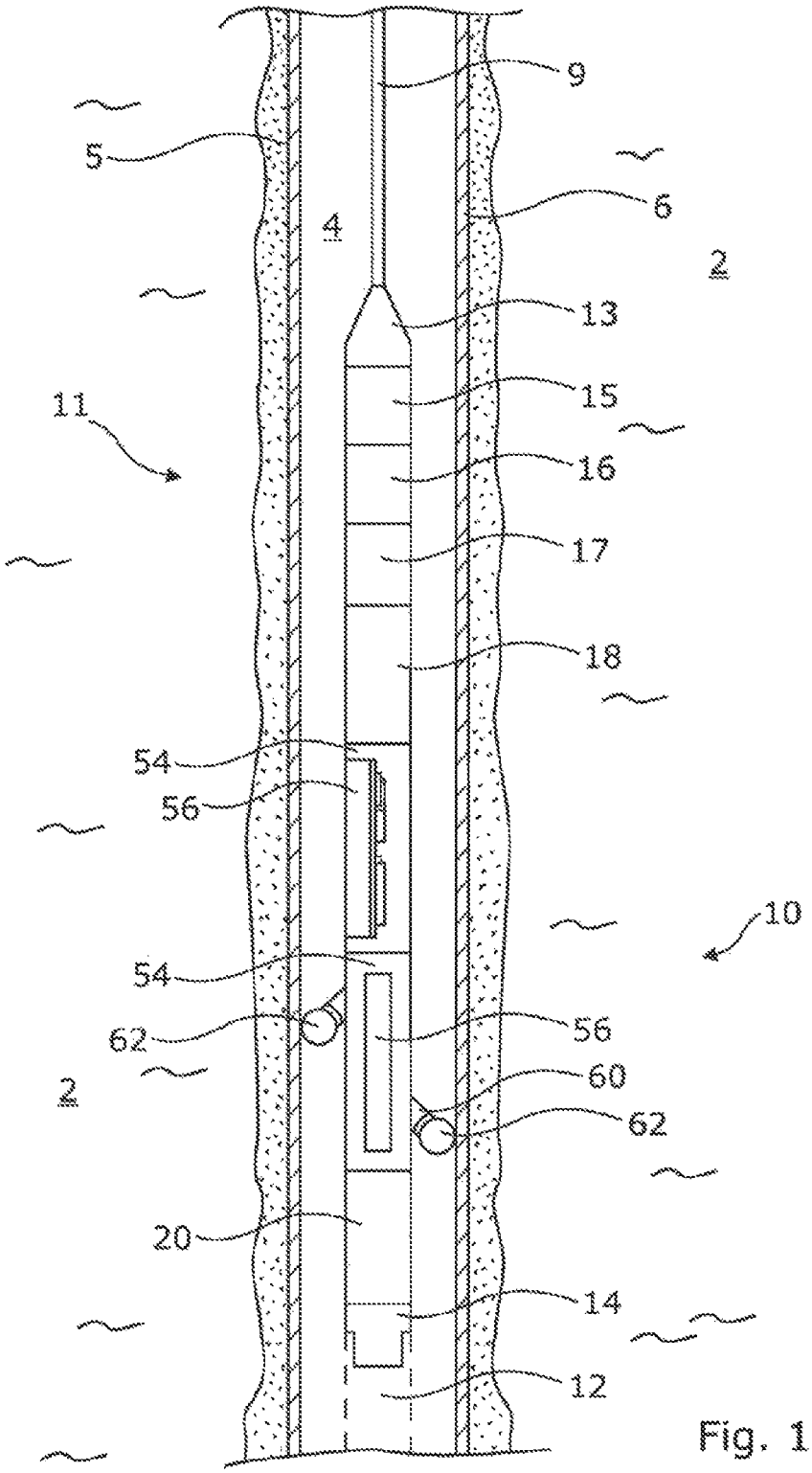
FIG. 1 shows a downhole tool suspended in a well with arms in a projecting position.

FIG. 1 shows a tool string 10 comprising a downhole tool 11 suspended in a well bore 4 or cased well. The downhole tool comprises several arm assemblies 60 projecting from the downhole tool towards the casing 6 or side walls of the well. The arm assemblies 60 can be moved between a retracted position and a projecting position. The arm assemblies 60 may have several difference functionalities and could accommodate wheels 62, anchor elements, centralizer devices or other devices required to be able to move between a retracted position and an extending or projecting position. Thus, the downhole tool 11 may have several different functionalities according to the configuration of the arm assemblies 60. The downhole tool 11 may be used as a transportation tool wherein projecting wheels rotate to drive forward the downhole tool or tool string. The downhole tool 11 may also be used as an anchoring tool for fixating the tool string 10 in the well or as a centraliser device for positioning the tool string 10 are/is suspended from and powered through a wireline 9 which is connected with the tool through a top connector 13. The downhole tool 11 further comprises an electronic section having modeshift electronics 15 and control electronics 16. The electronic section controls the electricity supply before it is directed to an electrical motor 17 driving a hydraulic pump 18.

Figure 2:
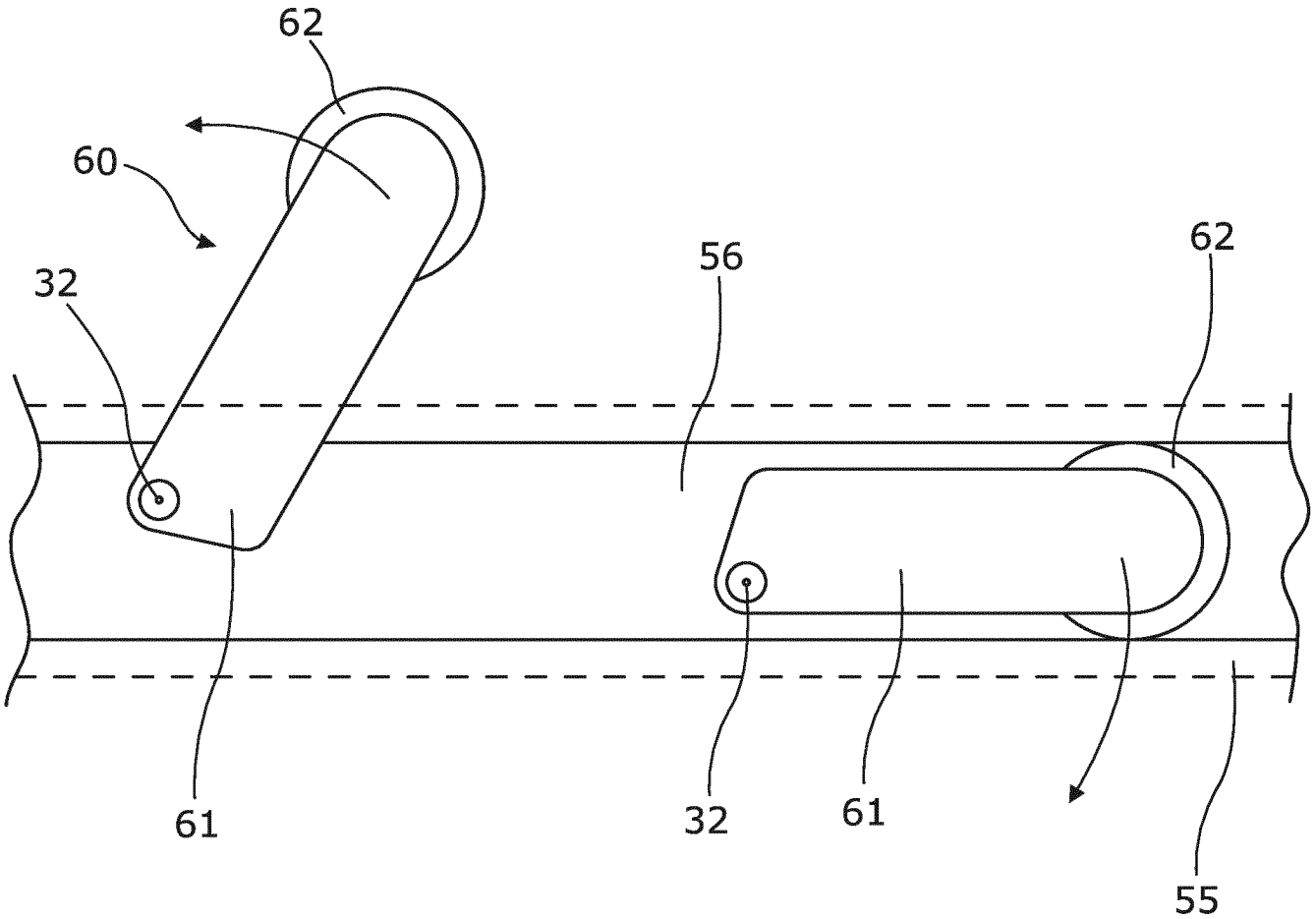
FIG. 2 shows, for illustrative purposes, a top view of part of a downhole tool with one arm assembly in a projecting position and another arm assembly in a retracted position.

The downhole tool 11 extends in a longitudinal direction and comprises one or more tool housings 54 arranged end to end with their respective end faces connected with each other. The downhole tool 11 further comprises multiple arm assemblies 60 (shown in FIG. 2) and multiple arm activation assemblies 40 (shown in FIG. 3). In FIG. 2, two arm assemblies 60 are shown in the projecting position and the retracted position, respectively, for illustrative purposes as the arm assemblies in a downhole tool according to the invention usually move in a synchronised manner wherein all the arm assemblies are either retracted or projecting at the same time.

Figure 3:
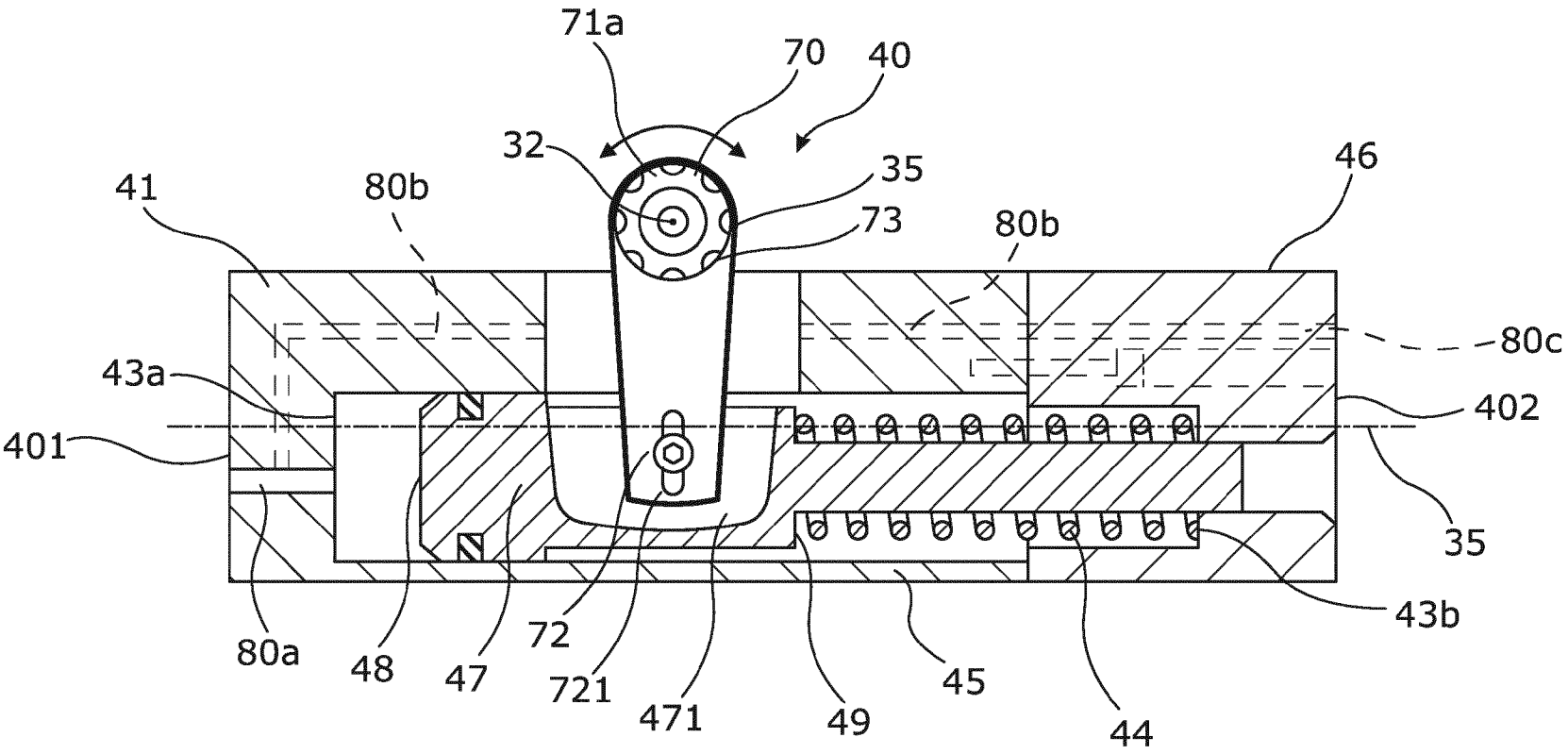
FIG. 3 shows a cross-sectional view of an arm activation assembly.

FIG. 3 shows the arm activation assembly 40 for moving an arm assembly 60 between the retracted position and the projecting position as shown in FIG. 2. The arm activation assembly 40 is arranged in the tool housing of the downhole tool and comprises a piston housing 41 having a piston chamber 42 extending in the longitudinal direction of the downhole tool. The piston housing 41 is divided into a first piston housing part 45 and a second piston housing part 46 and the piston chamber 42 extends into both piston housing parts. The first piston housing part 45 defines a first end face 43*a* of the piston chamber 42, and the second piston housing part defines a second end face 43*b* of the piston chamber 42. Inside the piston housing 41, a piston member 47 is arranged which is movable in the longitudinal direction of the downhole tool 11. The piston member 47 is moved in a first direction towards the second end face 43*b* by a fluid acting on a first piston surface 48. The fluid is supplied to a part of the piston chamber 42 in front of the piston member 47 via fluid channel 80*a*. Further, a spring member is arranged in the piston chamber 42 to move the piston member 47 in a second direction opposite the first direction towards the first end face 43*a* of the piston chamber 42. It is obvious to the person skilled in the art that the coiled spring may be replaced by e.g. a gas piston or other resilient member capable of exerting a force when it has been compressed.

The arm activation assembly 40 further comprises a torque member 70 for converting reciprocation of the piston member into a rotation force. The torque member 70 is rotated by the piston member 47 and connected with the arm assembly 60 to transfer the rotation force required to move the arm assembly 60 between the retracted position and the projecting position. The torque member 70 may be connected to the piston member 47 using various design principles such as, but not limited to, a rack also known as a toothed rack or gear-rack, a worm shaft or a sliding pivot joint.

Figure 4B:
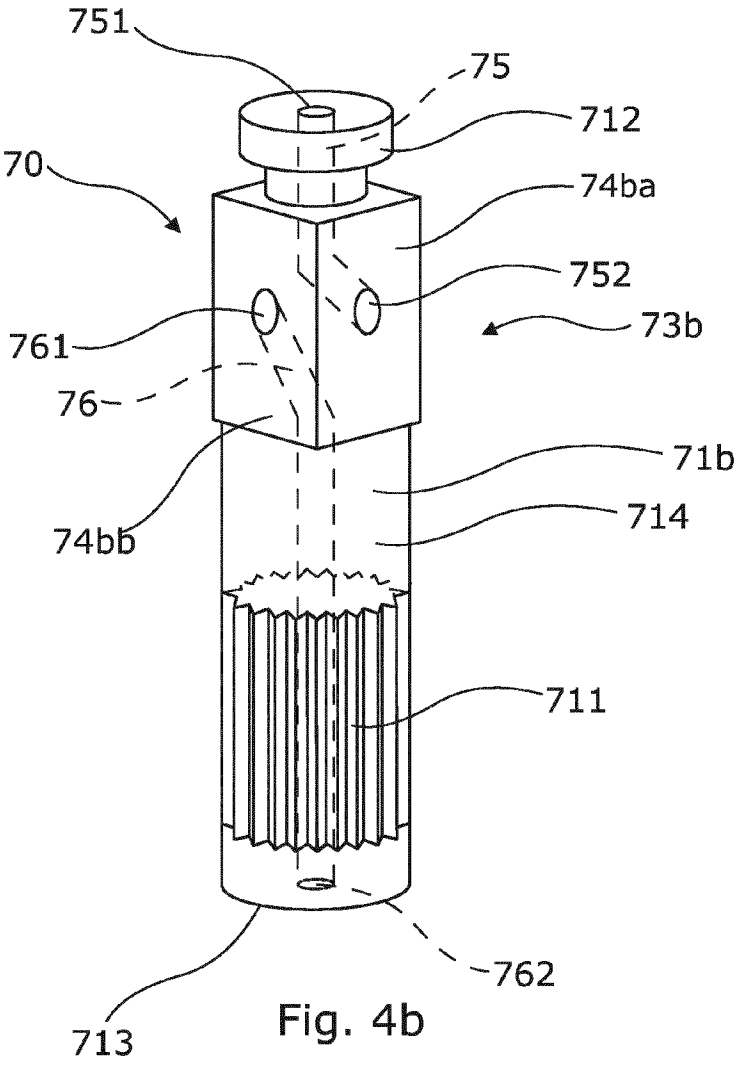
FIG. 4*b* shows another torque member.
Figure 4A:
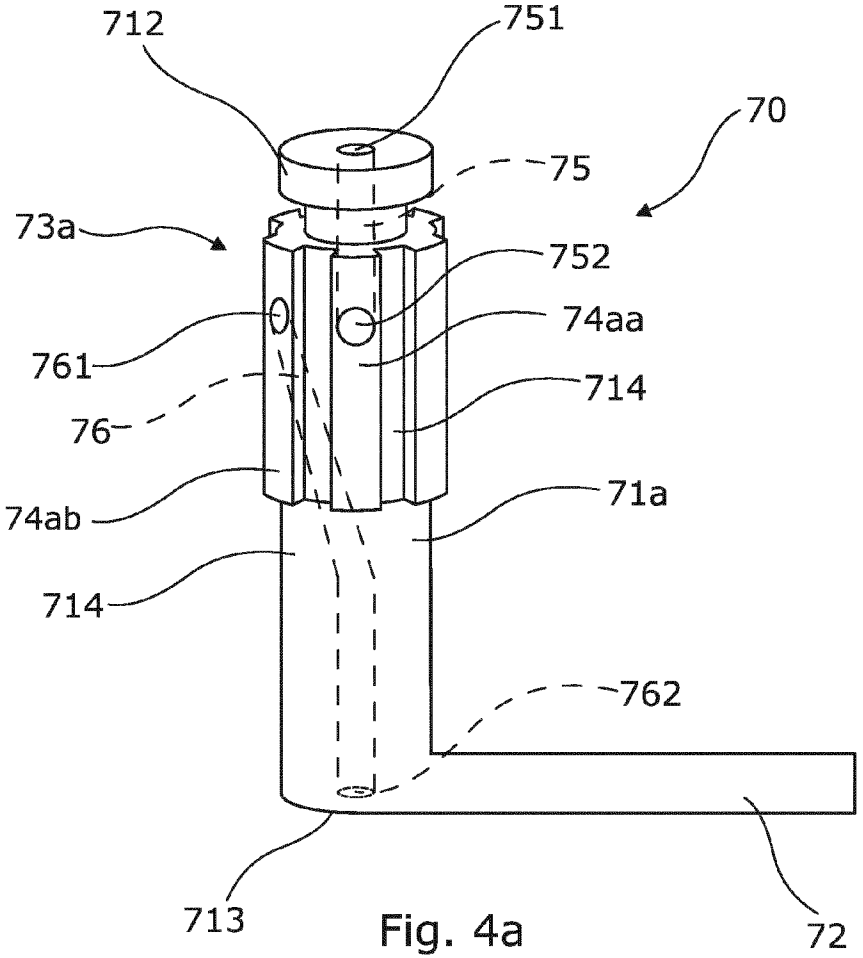
FIG. 4*a* shows a torque member.

FIGS. 4*a* and 4*b* show different designs of a torque member. In FIG. 4*a*, the torque member 70 is constituted by a shaft part 71*a* and a crank arm 72 projecting substantially radially from an end of the shaft part. The shaft part 71*a* comprises an arm member interface 73*a* and extends between a first end 712 and a second end 713. The crank arm 72 is connected with the piston member by the crank arm being arranged in a recess 471 in the piston member 47 and fastened by a sliding pivot joint as shown in FIG. 3. In FIG. 4*b*, the torque member 70 is constituted by a shaft part 71*b* comprising an arm member interface 73*b* and a piston member interface 711 provided as a toothed section extending in the periphery of the shaft part 71*b*. The piston member interface 711 may be connected to a piston member 47 comprising a toothed rack or a gear-rack.

Figure 8:
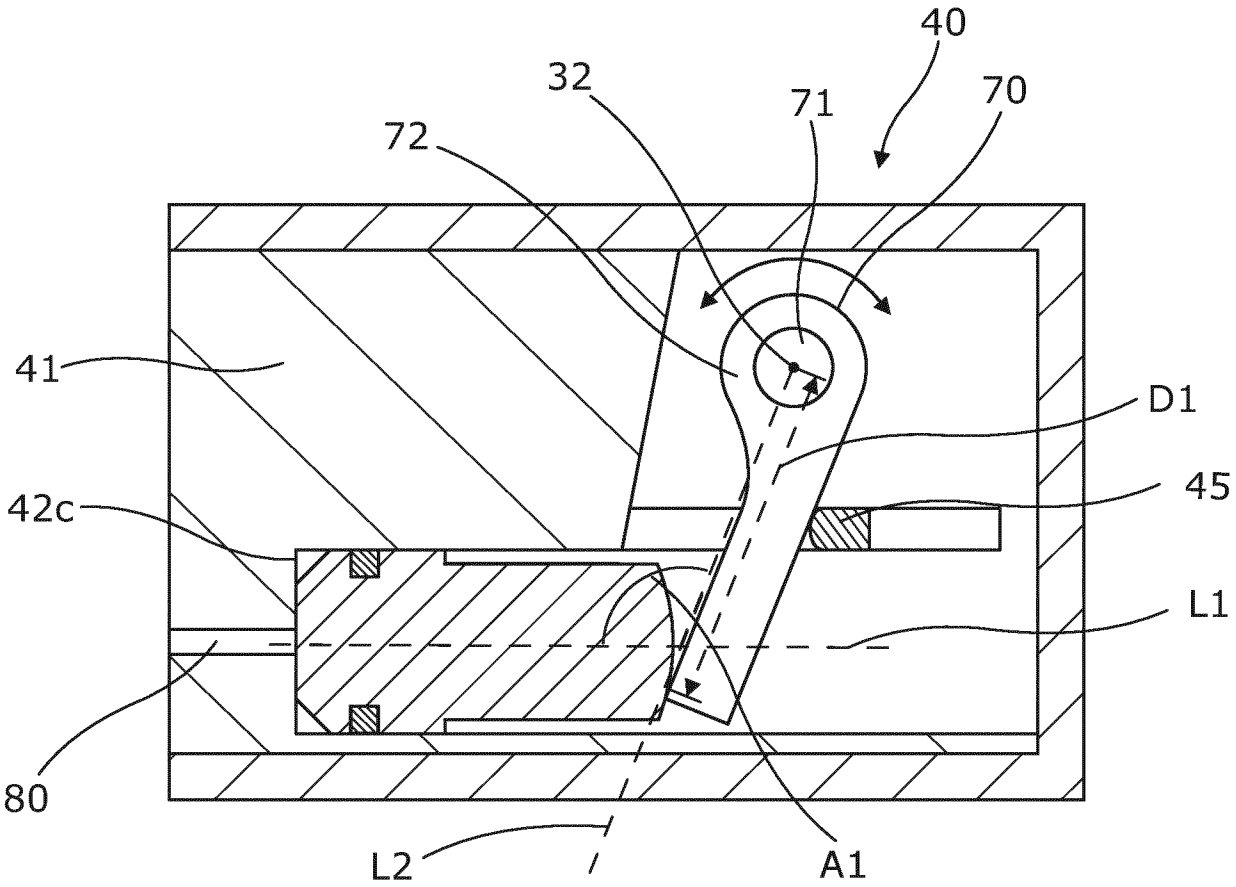
FIG. 8 shows a cross-sectional view of another design of the arm activation assembly in a retracted position.
Figure 9:
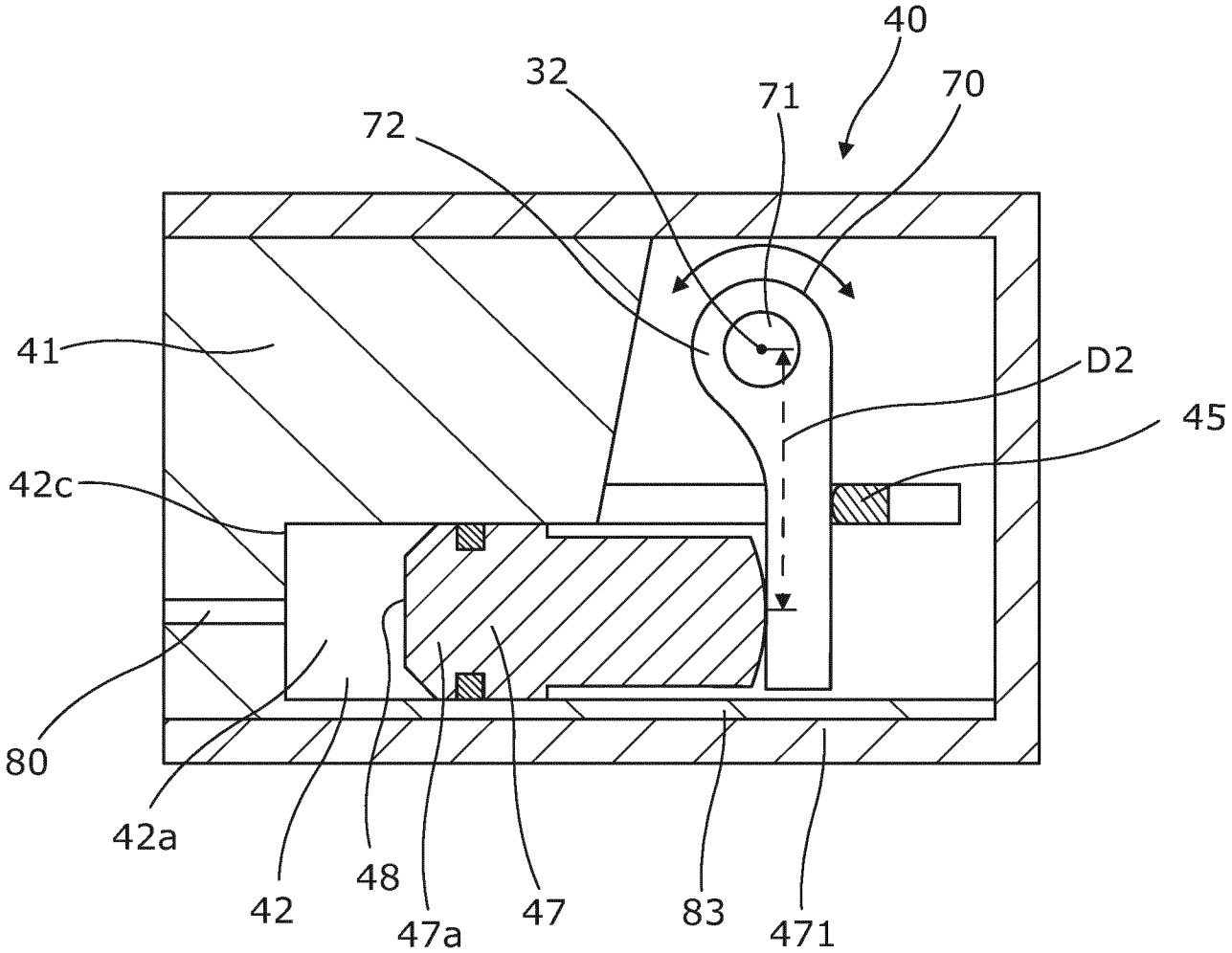
FIG. 9 shows a cross-sectional view of the arm activation assembly of FIG. 8 in an intermediate position.
Figure 10:
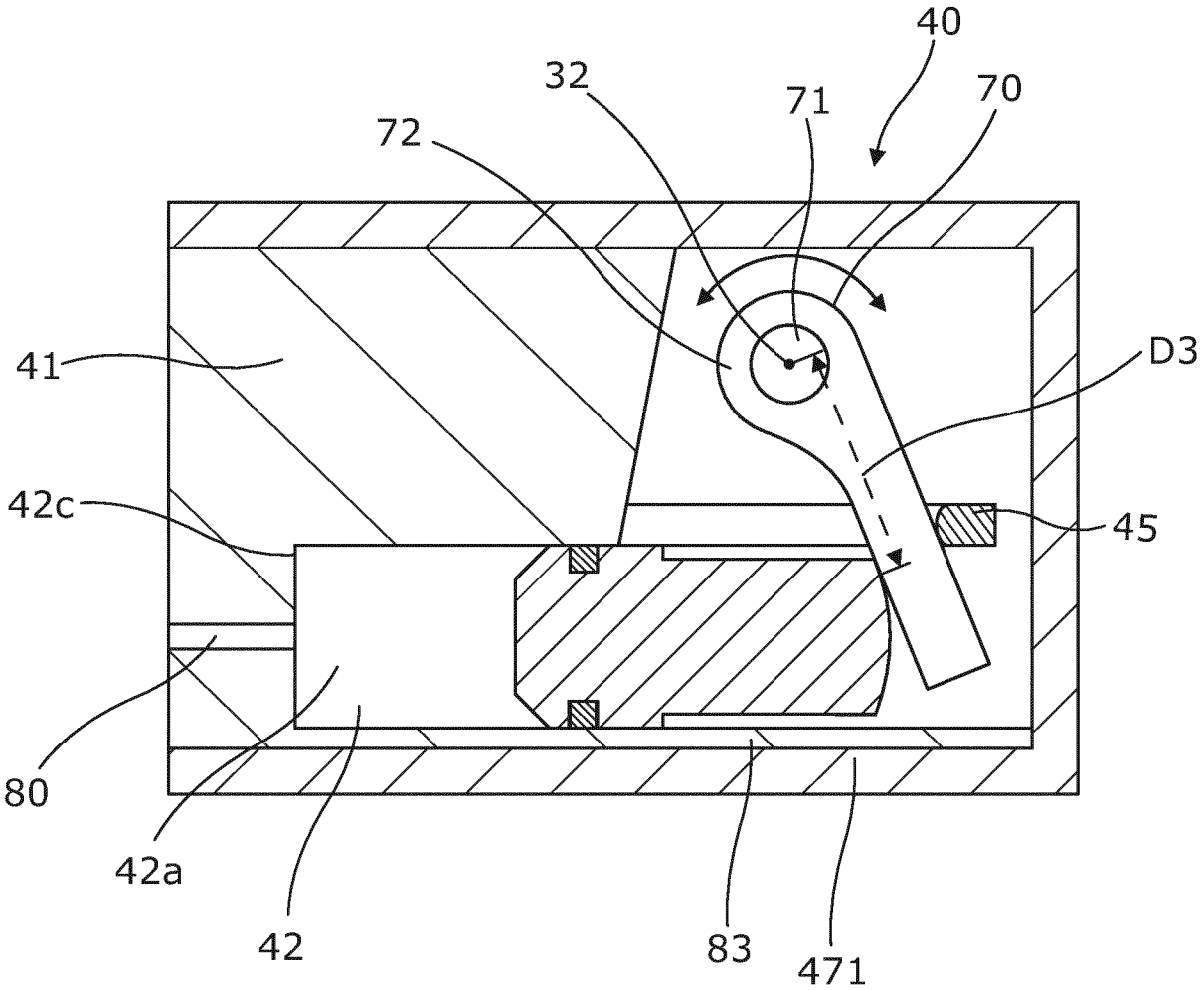
FIG. 10 shows a cross-sectional view of the arm activation assembly of FIG. 8 in a projecting position.

FIGS. 8-10 show cross-sectional views of another design of the arm activation assembly in a retracted position (FIG. 8), in an intermediate position (FIG. 9) and in a projecting position (FIG. 10). In this design the spring member 44 may be arranged in a different chamber than the piston member 47, as shown in FIGS. 11*a*-*b* and FIGS. 12*a*-*b*. In order to minimize the use of space in the downhole tool in the longitudinal direction, the spring member 44 may be arranged substantially side-by-side to the piston member 47 (see FIGS. 11*a* and 11*b*) instead of substantially end-to-end, as seen in FIG. 3. If the spring member 44 and piston member 47 are arranged side-by-side, the spring member may apply a retracting force to crank arm 72 by an intermediate member 45.1. Alternatively, the spring member may apply a retracting force directly to the arm assembly (not shown).

As shown in FIGS. 8-10, the distance D1, D2, D3 between the rotation axis 32 and a point of contact between the crank arm 72 and the piston member 47 is preferably longer in the retracted position than in the projecting position such that a resulting projecting force applied to the arm assembly by the arm activation assembly is decreasing from a high resulting projection force in the retracted position towards a lower resulting projection force in the projecting position. This decreasing resulting projecting force ensures that the tool string is well centralised in the production casing during projection of the arm assembly, because the further out the arm assembly is projecting, the smaller the resulting projecting force. Hereby, the resulting force will always be highest on the parts of the arm assembly which are projecting to a smaller degree, thereby always ensuring that the tool string automatically will be well centralised in the production casing or well bore.

Figure 11A:
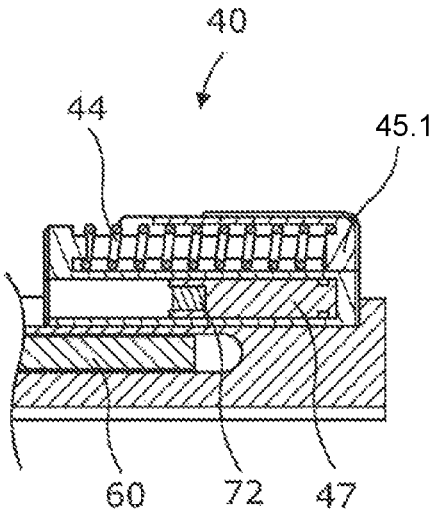
FIG. 11*a* shows a cross-sectional view of an arm activation assembly when the arm assembly is in a retracted position.
Figure 11B:
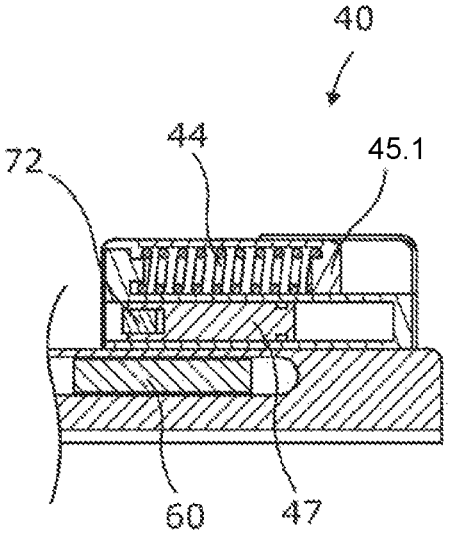
FIG. 11*b* shows a cross-sectional view of the arm activation assembly of FIG. 11*a* when the arm assembly is in a projecting position.
Figure 12A:
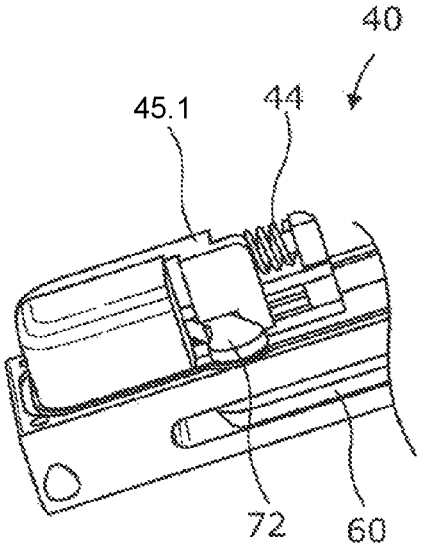
FIG. 12*a* shows a perspective view of the arm activation assembly shown in FIG. 11*a*.
Figure 12B:
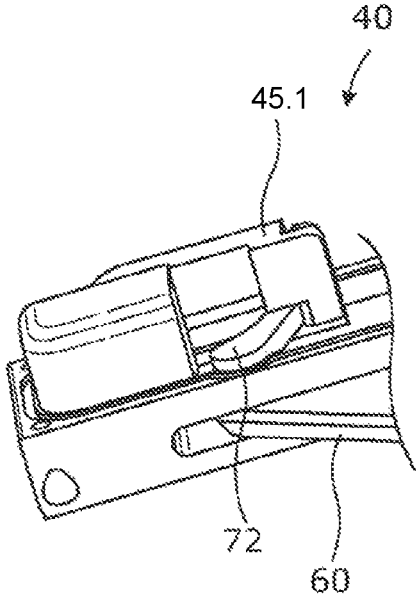
FIG. 12*b* shows a perspective view of the arm activation assembly shown in FIG. 11*b*

FIG. 11*a* shows a cross-sectional view of an arm activation assembly 40 in retracted position, where the piston member 47 and spring member 44 are arranged substantially side-by-side in the longitudinal direction of the tool string. As seen, this may save space in the longitudinal direction, and thus the tool can be made shorter in length. Since the spring member 44 in this embodiment is not arranged in direct contact with the piston member 47, an intermediate member 45.1, also shown in FIGS. 12*a*-*b*, applies the spring force to the piston member in a direction opposite to the projection force. FIG. 11*b* shows a cross-sectional view of the same arm activation assembly 40 shown in FIG. 11*a* with the arm assembly 60 in a projecting position. FIGS. 12*a* and 12*b* show perspective views of the arm activation assembly shown in FIGS. 11*a* and 11*b*, respectively. As shown in FIGS. 12*a* and 12*b*, it is not required that the spring member 44 is arranged in a confined chamber as long as the spring force acts opposite to the projecting force of the piston such that the arm assembly is retracted if hydraulic pressure on the piston member is lost, hence ensuring a fail-safe retraction mechanism independent of hydraulic pressure in the tool.

Further, the crank arm 72 may be constructed in an asymmetric shape as best seen in FIGS. 8-10. The asymmetric design has the effect that, in the retracted position, an angle A1 between the direction of the piston member 47, as illustrated by dotted line L1, and the resulting direction of transmission of the force through the crank arm 72, as illustrated by the dotted line L2, is reduced compared to a crank arm of a symmetric design. Hereby, when the arm activation assembly is in the retracted position, the force transmission between the piston member 47 and the torque member 70 is improved. This contributes to the above described effect of the resulting projecting force applied to the arm assembly by the arm activation assembly decreasing from a high resulting projection force in the retracted position towards a lower resulting projection force in the projecting position.

FIG. 4*a* shows a multilateral arm member interface 73*a* comprising multiple protrusions having outer faces 74*aa*, 74*ab* and grooves 714 extending in a longitudinal direction of the torque member 70. The grooves and protrusions are arranged along a periphery of the torque member and adapted to engage with corresponding grooves and protrusions of a circumferential wall 671 defined by a through hole 67 in an arm member 61 (shown in FIGS. 5 and 6) of the arm assembly 60. FIG. 4*b* shows a rectangular arm member interface 73*b* provided with multiple outer faces 74*ba*, 74*bb* having a rectangular geometry adapted to engage with a similar geometry of the through hole 67 in the arm member 61 (shown in FIG. 5). The multifaced geometry of the arm member interface and the corresponding hole in the arm member are adapted for transferring a torque between the torque member 70 and the arm member 61. By arranging the arm member interface in the hole in the arm member 61, the outer faces of the arm member interface mate with corresponding faces of the hole in the arm. Faces of the arm member interface 73*a* and the through hole 67 thus abut against each other, whereby the torque member 70 is rotatably secured to the arm member 61.

Further, the torque member 70 comprises a first fluid channel 75 provided in the shaft part. In the following, the first fluid channel will be denoted as the fluid supply channel. The fluid supply channel 75 has an inlet 751 arranged substantially in the centre of the shaft part at the first end 712 and an outlet 752 arranged in an outer face 74*aa*, 74*ba* of the arm member interface 73*a*, 73*b*. The fluid supply channel 75 runs through an internal part of the torque member 70, thereby connecting the inlet and the outlet, and may be e.g. drilled, machined or cast in a manner known to the person skilled in the art. In an alternative design, part of the fluid supply channel 75 may be constituted by a groove or a recess milled or otherwise provided in an outer surface of the shaft part 71*a*, 71*b*. Such groove or recess may cooperate with the faces of the hole in the arm member 61 to provide a fluid supply channel connecting an inlet and an outlet. By comprising a fluid supply channel and providing a link between the piston member and the arm assembly, the torque member thus has the dual functionality of simultaneously transferring torque between the arm activation assembly and the arm assembly and supplying hydraulic fluid to the arm assembly.

The torque member may comprise an additional second fluid channel 76 also provided in the shaft part and denoted as the fluid return channel. The fluid return channel has an inlet 761 arranged in an outer face 74*ab*, 74*bb* different from the outer face 74*aa*, 74*ba* in which the outlet 752 of the fluid supply channel is arranged. By having the outlet 752 and the inlet 761 arranged on separate projecting faces, the sealing properties are improved, whereby the risk of cross-flow between the outlet 752 and the inlet 761 is reduced. The outlet 762 of the fluid return channel is provided in the second end 713 of the shaft part.

Figure 5:
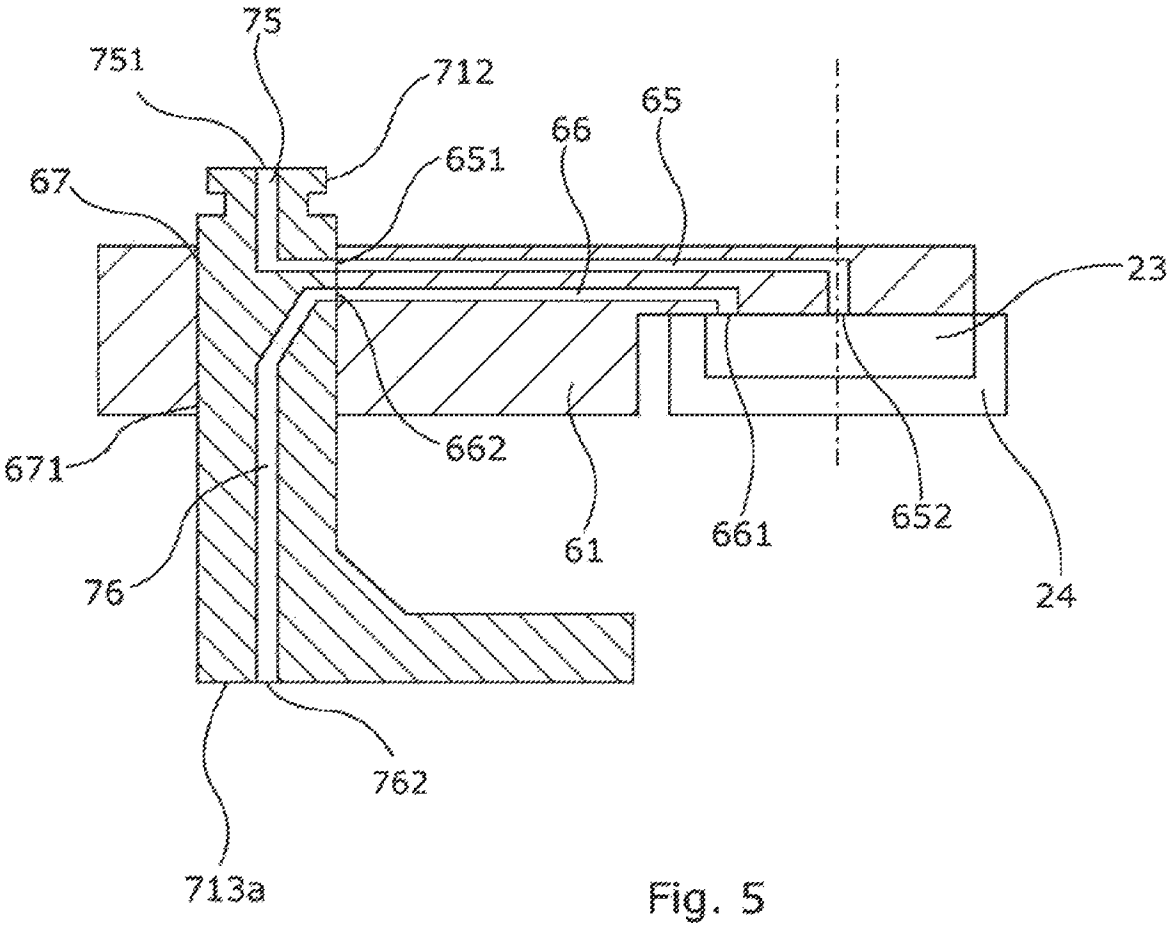
FIG. 5 shows a cross-sectional side view of an arm assembly and a torque member.

FIG. 5 shows how the torque member 70 is connected with the arm member 61 of the arm assembly 60. In the shown design, the arm assembly 60 comprises the arm member 61, a hydraulic motor 23 and a rotational part 24. In another design, the rotational part may be omitted and the hydraulic motor substituted by a different hydraulic entity such as, but not limited to, a piston, a cutting device, a drilling device, etc. The rotational part may provide a rolling ring or wheel for driving the downhole tool 11 forward.

The arm member 61 comprises internal fluid channels to supply hydraulic fluid to the hydraulic motor 23. The fluid channels of the arm member 61 are connected to the fluid channels of the torque member 70, whereby hydraulic fluid may be supplied into the arm member 61 via the torque member 70. The fluid supply is thus integrated into the moving parts, i.e. the torque member 70 and the arm member 61, whereby e.g. the use of external hoses or pipes can be avoided.

As previously mentioned, the arm member 61 comprises a through hole having a geometry adapted to engage with the geometry of the arm member interface of the torque member. The through hole defines a circumferential wall 671 constituted by the arm member 61. The circumferential wall 671 comprises a multiplicity of grooves having faces 672 and protrusions 673 arranged along the circumference of the hole. The grooves in the circumferential wall 671 are adapted to receive corresponding protrusions of the arm member interface of the torque member 70. The faces of the grooves in the through hole and the faces of the protrusions of the arm member interface abut against each other and engage in a sliding manner when the torque member 70 is inserted into the arm member 61. By arranging an outlet and an inlet on two opposite faces abutting each other, a substantially fluid-tight connection between the outlet and the inlet is provided. In this regard, the fit between the faces, i.e. between the arm member interface of the torque member and the hole in the arm member, is of great importance to the sealing properties of the connection. Proper tolerances in this respect are known to the person skilled in the art.

The fluid supply channel of the torque member is connected with an influx fluid channel 65 integrated in the arm member 61. The influx fluid channel has an inlet 651 arranged in fluid communication with the outlet 752 of the fluid supply channel and an outlet 652 fluidly connected with the hydraulic motor 23. Further, a reflux fluid channel 66 having an inlet 661 and an outlet 662 is provided in the arm member 61. The inlet 661 of the reflux fluid channel 66 is in fluid communication with the hydraulic motor 23, whereby the reflux fluid channel 66 may be used as a drain for the hydraulic motor 23. The outlet 662 is fluidly connected with the inlet of the fluid return channel 76 of the torque member 70 to direct the fluid from the hydraulic motor 23 via the fluid reflux channel 66 and into the fluid return channel 76.

Figure 6:
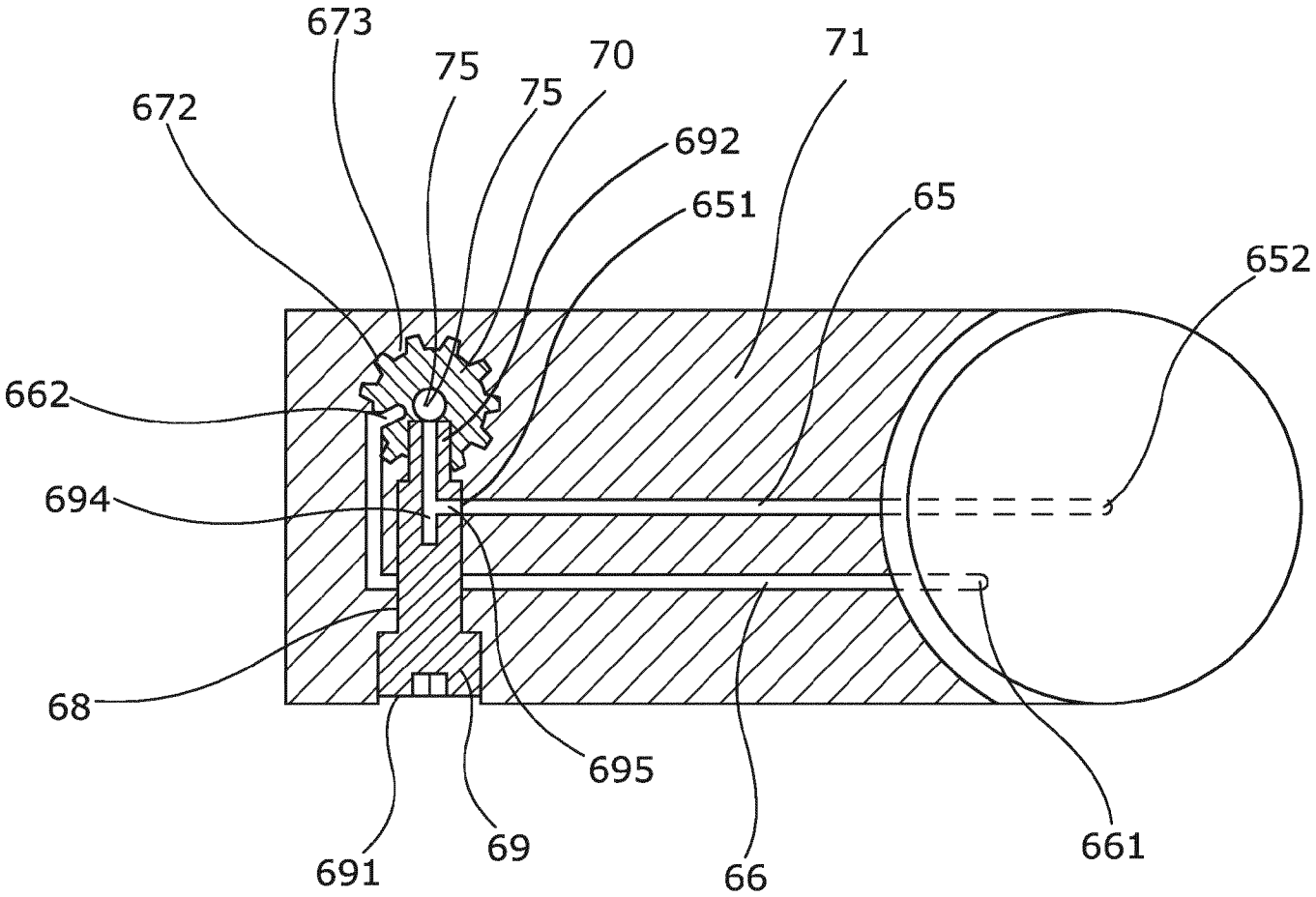
FIG. 6 shows an arm assembly comprising a tube member.

FIG. 6 shows another design for an arm assembly wherein the arm member comprises a bore 68 extending from a side face thereof and into contact with the through hole 67. A tube member 69 comprising an inner bore 694 is provided in the bore. The tube has a first end 691 and a second end 692 engaging with the outlet of the fluid supply channel 75 of the torque member 70. The tube member 69 may be a threaded bolt arranged in a threaded connection with the arm member 61. The inner bore of the tube member 69 extends between an inlet in the second end 692 and an outlet 695 provided in a side wall of the tube member 69. The inner bore thereby fluidly connects the fluid supply channel 75 of the torque member 70 with the influx fluid channel 65 of the arm member 61. By providing a tube member for fluidly connecting the fluid supply channel and the influx fluid channel, the sealing properties of the entire fluid supply to the hydraulic motor is improved. Providing a fluid-tight supply channel is of considerable importance in relation to the sealing quality of the channel providing drainage for the hydraulic motor 23. The fluid supplied to the hydraulic motor 23 must be under a substantial pressure for the motor to work properly. If the pressure is too low, the hydraulic motor 23 will be unable to provide the necessary force to propel the rotating member and drive forward the downhole tool 11. The tube member 69 further has the functionality of securing the torque member 70 in the hole of the arm member 71 by engaging with the outlet of the fluid supply channel.

Figure 7:
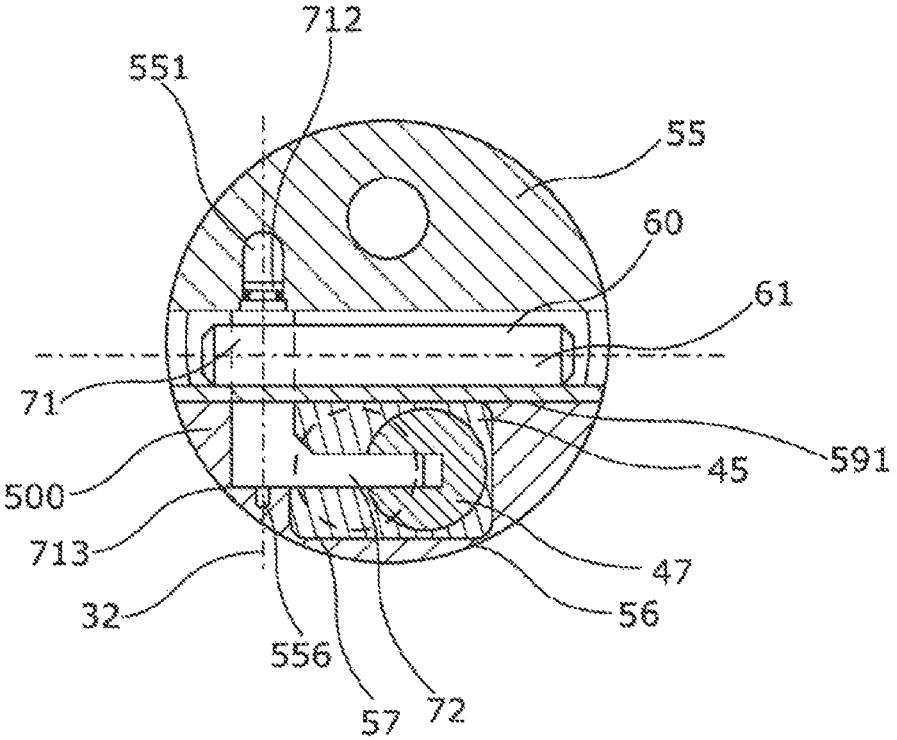
FIG. 7 shows a cross-sectional view of a downhole tool transverse to the longitudinal direction.

FIG. 7 shows a cross-section of the downhole tool 11, illustrating how the tool housing 54 is divided into a first tool housing part 55 and a second tool housing part 56. Further, it is shown how the first end 712 of the torque member 70 extends into the first tool housing part 55 and the second end 713 extends into the second tool housing part 56. The first tool housing part 55 comprises a fluid supply channel 551 and the second tool housing part 56 comprises a fluid return channel 556. The inlet 751 (shown in FIG. 5) of the fluid supply channel of the torque member 70 is in fluid communication with the fluid supply channel 551 of the first tool housing part 55 and the outlet 762 (shown in FIG. 5) of the fluid return channel of the torque member 70 is in fluid communication with the fluid return channel 561 of the second tool housing part 56. Hereby, fluid may be supplied to the inlet 751 of the torque member 70, and drainage may be provided through the outlet 762.

The hydraulic pump of the downhole tool 11 may be used for supplying hydraulic fluid under pressure to the fluid supply channel 551 of the first tool housing part 55. Hereby, hydraulic fluid is supplied to the hydraulic motor 23 via the integrated fluid channels in the torque member 70 and the arm member 61, and the hydraulic motor 23 is driven by the hydraulic pump. Alternatively, pressurised hydraulic fluid may be supplied to the fluid supply channel 551 of the first tool housing part 55 by means of coiled tubing or another kind of hose system connected to the downhole tool 11. In this way, the utilised hydraulic fluid may be pressurised externally to the downhole tool, e.g. at the surface of the well.

Further, FIG. 1 shows how the downhole tool 11 may be connected to one or more operational downhole tools 12, thereby constituting a tool string 10. Such operational tools could be a stroker tool providing an axial force in one or more strokes, a key tool opening or closing valves in the well, positioning tools such as a casing collar locator (CCL), a milling tool, a drilling tool, a logging tool, etc.

Although the invention has been described in the above in connection with preferred embodiments of the invention, it will be evident for a person skilled in the art that several modifications are conceivable without departing from the invention as defined by the following claims.

The invention claimed is:

1. A downhole tool extending in a longitudinal direction, comprising:

a tool housing;

an arm assembly movable between a retracted position and a projecting position in relation to the tool housing; and an arm activation assembly arranged in the tool housing for moving the arm assembly between the retracted position and the projecting position, the arm activation assembly comprising:

a piston chamber extending in the longitudinal direction of the downhole tool, and a piston member arranged inside the piston chamber and movable in the longitudinal direction of the downhole tool, wherein the arm activation assembly further comprises a torque member comprising a first fluid channel for supplying hydraulic fluid from a pump to the arm assembly, the torque member being connected with the arm assembly and wherein the torque member is rotated by the movement of the piston member, whereby the arm assembly is moved.

2. A downhole tool according to claim 1, wherein the torque member is a cylindrical member having an external surface extending in a periphery of the cylindrical member, the torque member further having a first and a second end face, and wherein the first fluid channel extends between an inlet provided in the first end face of the torque member and an outlet provided in the external surface.

3. A downhole tool according to claim 1, the torque member comprising a second fluid channel extending between a second inlet and a second outlet.

4. A downhole tool according to claim 3, wherein the inlet of the second fluid channel is provided in the external surface of the torque member and the outlet of the second fluid channel is provided in the second end face.

5. A downhole tool according to claim 1, the arm assembly comprising an arm member connected with the torque member, a hydraulic motor, and a rotational part, the hydraulic motor being arranged at an end of the arm member and rotationally connected with the rotational part to rotate the rotational part and thereby drive the downhole tool forward.

6. A downhole tool according to claim 5, the arm member comprising a fluid influx channel fluidly connected with the first fluid channel of the torque member, whereby hydraulic fluid may be supplied from the first fluid channel in the torque member and into the first fluid channel in the arm member.

7. A downhole tool according to claim 6, wherein the arm member comprises a through hole extending from one side of the arm member to another and defining a circumferential wall, wherein a part of the torque member constituting an arm member interface extending in a longitudinal direction of the torque member, and wherein the outlet of the first fluid channel of the torque member is arranged in the arm member interface and an inlet of the fluid influx channel is arranged in the circumferential wall defined by the through hole, the arm member interface being adapted to engage with the through hole, so that the outlet and the inlet are fluidly connected.

8. A downhole tool according to claim 6, the arm member further comprising a fluid reflux channel fluidly connected with the second fluid channel of the torque member.

9. A downhole tool according to claim 7, wherein the through hole has a cross-sectional shape, in a direction transverse to the extension of the through hole, corresponding to a cross-sectional shape of the arm member interface, in a direction transverse to the longitudinal direction of the torque member, the cross-sectional shape of both the though hole and the arm member interface being two-sided, trilateral, triangular, rectangular, multilateral, or oval.

10. A downhole tool according to claim 7, wherein the through hole has a geometry comprising multiple faces and the arm member interface has a geometry comprising multiple faces and the outlet and the inlet of both the through hole and the arm member interface are arranged on separate faces.

11. A downhole tool according to claim 6, the arm assembly further comprising a tube member arranged in a bore in the arm member for fluidly connecting the first fluid channel of the torque member with the fluid influx channel of the arm member, whereby the tube member provides a fluid communication between the first fluid channel and the fluid influx channel.

12. A downhole tool according to claim 2, the tool housing comprising a fluid supply channel and wherein the first fluid channel of the torque member is fluidly connected with the fluid supply channel of the tool housing by the first end face of the torque member extending into the tool housing.

13. A downhole tool according to claim 12, the tool housing comprising a first tool housing part and a second tool housing part, wherein a fluid return channel is provided in the second tool housing part and the fluid supply channel is provided in the first tool housing part, and wherein the second fluid channel of the torque member is fluidly connected with the fluid supply channel by the second end face of the torque member extending into the second tool housing part.

14. A downhole system comprising the downhole tool according to claim 1 and an operational tool connected with the downhole tool for being moved forward in a well or borehole.

* * * * *